US011603280B2

(12) United States Patent
Gnan et al.

(10) Patent No.: US 11,603,280 B2
(45) Date of Patent: Mar. 14, 2023

(54) ASSEMBLY FOR A CORRUGATOR PLANT

(71) Applicant: BHS Corrugated Maschinen—und Anlagenbau GmbH, Weiherhammer (DE)

(72) Inventors: Alfons Gnan, Vilseck (DE); Florian Müller, Weiherhammer (DE); Maximilian Rosemann, Vilseck (DE)

(73) Assignee: BHS Corrugated Maschinen—und Anlagenbau GmbH, Weiherhammer (DE)

( * ) Notice: Subject to any disclaimer, the term of this patent is extended or adjusted under 35 U.S.C. 154(b) by 334 days.

(21) Appl. No.: 16/858,051

(22) Filed: Apr. 24, 2020

(65) Prior Publication Data

US 2020/0369487 A1 Nov. 26, 2020

(30) Foreign Application Priority Data

May 23, 2019 (DE) ..... 10 2019 207 589.4

(51) Int. Cl.

| | |
|---|---|
| ***B65H 23/032*** | (2006.01) |
| ***B65H 23/02*** | (2006.01) |
| ***B65H 37/04*** | (2006.01) |
| ***B65H 27/00*** | (2006.01) |
| ***B31F 1/28*** | (2006.01) |
| ***B31D 3/00*** | (2017.01) |

(Continued)

(52) U.S. Cl.

CPC ..... *B65H 23/0326* (2013.01); *B31D 3/005* (2013.01); *B31F 1/2836* (2013.01); *B31F 5/04* (2013.01); *B65H 23/0204* (2013.01); *B65H 27/00* (2013.01); *B65H 37/04* (2013.01); *B65H 21/00* (2013.01)

(58) Field of Classification Search

CPC ..... B31F 1/28; B65H 19/18; B65H 19/1805; B65H 23/02; B31D 3/005

USPC ..... 493/34; 156/470

See application file for complete search history.

(56) References Cited

U.S. PATENT DOCUMENTS 3,152,941 A * 10/1964 Sherman ..... B65H 23/0326 226/22
4,392,910 A * 7/1983 Tokuno ..... B65H 23/0326 226/15

(Continued)

FOREIGN PATENT DOCUMENTS

DE 3138673 A1 4/1982
DE 102014207050 A1 10/2015

(Continued)

*Primary Examiner* — Andrew M Tecco
*Assistant Examiner* — Jacob A Smith
(74) *Attorney, Agent, or Firm* — McGlew and Tuttle, P.C.

(57) ABSTRACT

An assembly comprises a device for producing a corrugated board web laminated on one side comprising a fluting device for fluting a first material web and a pressing device for pressing the glued corrugated web and a second material web against one another. The assembly comprises a first transverse position detecting device, upstream the fluting device, for detecting the first material web, a second transverse position detecting device, upstream the pressing device, for detecting the second material web and a signal processing unit, which is capable of actuating a unrolling device for unrolling the second material web so that in the device for producing a corrugated board web it is transversally displaced correspondingly.

20 Claims, 3 Drawing Sheets

(51) Int. Cl.
*B31F 5/04* (2006.01)
*B65H 21/00* (2006.01)

(56) References Cited

U.S. PATENT DOCUMENTS

| | | | | |
|---|---|---|---|---|
| 2007/0137788 | A1* | 6/2007 | Loffler | B31F 1/2836 156/324 |
| 2015/0291380 | A1* | 10/2015 | Fischer | B65H 19/1805 242/552 |

FOREIGN PATENT DOCUMENTS

| | | | | |
|---|---|---|---|---|
| EP | 1757548 | A1 * | 2/2007 | B31F 1/2836 |
| EP | 1757548 | A1 | 2/2007 | |
| JP | S5812546 | U | 1/1983 | |
| JP | S6255125 | A | 3/1987 | |
| JP | H08258187 | A | 10/1996 | |

* cited by examiner

ASSEMBLY FOR A CORRUGATOR PLANT

CROSS-REFERENCES TO RELATED APPLICATIONS

This application claims the priority of German Patent Application, Serial No. 10 2019 207 589.4, filed May 23, 2019, pursuant to 35 U.S.C. 119(a)-(d), the content of which is incorporated herein by reference in its entirety as if fully set forth herein.

FIELD OF THE INVENTION

The invention relates to an assembly, which is in particular a component part of a corrugator. Furthermore, the invention is directed to a corrugator plant with at least one such assembly. The invention is also directed to a corresponding method.

BACKGROUND OF THE INVENTION

It is generally known from prior public use that, in the case of an assembly with a device for producing a corrugated board web which is laminated on one side and, preceding it, material-web unrolling devices, the material webs used in the device for producing a corrugated board web which is laminated on one side must be aligned with respect to their middle one after the other in order to allow cost-effective and economical production of the corrugated board web which is laminated on one side. For this purpose, usually first the material web to be corrugated is placed onto a fluted roller and aligned with respect to it. The other material web is then positioned centrally in relation to the material web to be corrugated. The positioning normally takes place manually on the unrolling devices. On the other hand, checking the correct positioning of the material webs in relation to one another by means of an operator is performed in the device for producing a corrugated board web which is laminated on one side. This procedure has been tried and tested in practice. However, it involves a not inconsiderable amount of work. Furthermore, it requires experience and skill.

SUMMARY OF THE INVENTION

The invention is based on an object of providing an assembly that overcomes the disadvantages of the prior art. In particular, it is intended to provide an assembly which is particularly user-friendly and cost-effective. A corresponding corrugator plant and a corresponding method are also to be provided.

This object is achieved according to the invention by an assembly, comprising a) a first unrolling device for unrolling a first material web from at least one first material web roll, b) a second unrolling device for unrolling a second material web from at least one second material web roll, c) a device for producing a corrugated board web which is laminated on one side from the first material web and the second material web, wherein the device for producing a corrugated board web which is laminated on one side has i. a fluting device for fluting the first material web to form a corrugated web, ii. a glue application device for gluing the corrugated web, iii. a pressing device for pressing the glued corrugated web and the second material web against one another to form a corrugated board web which is laminated on one side, and iv. an exit for the corrugated board web which is laminated on one side, d) a first transverse position detecting device, upstream the fluting device in conveying direction of the first material web, for detecting a respective first transverse position of the first material web to produce first transverse position signals of the first material web, e) a second transverse position detecting device, upstream the pressing device in conveying direction of the second material web, for detecting a respective second transverse position of the second material web to produce second transverse position signals of the second material web, and f) a signal processing unit, which i. is in signalling connection with the first transverse position detecting device for receiving the first transverse position signals of the first material web, ii. is in signalling connection with the second transverse position detecting device for receiving the second transverse position signals of the second material web, iii. is in signalling connection with the second unrolling device, and iv. when a transverse deviation between the first material web and the second material web is established on basis of the first and second transverse position signals over a setpoint value, is capable of actuating the second unrolling device in such a way that the second material web in the device for producing a corrugated board web which is laminated on one side is displaced in its transverse direction to reduce the transverse deviation.

The object is further achieved by a corrugator plant with at least one assembly according to the invention.

The object is further achieved by a method, comprising the steps of unrolling a first material from at least one first material web roll by means of a first unrolling device, unrolling a second material web from at least one second material web roll by means of a second unrolling device, producing a corrugated board web which is laminated on one side from the first material web and the second material web means of a device for producing a corrugated board web which is laminated on one side, wherein the device for producing a corrugated board web which is laminated on one side has a fluting device for fluting the first material web to form a corrugated web, a glue application device for gluing the corrugated web, a pressing device for pressing the glued corrugated web and the second material web to form the corrugated board web which is laminated on one side, and an exit for the corrugated board web which is laminated on one side, detecting a respective first transverse position of the first material web to produce first transverse position signals of the first material web by means of a first transverse position detecting device preceding the fluting device in conveying direction of the first material web, detecting a respective second transverse position of the second material web to produce second transverse position signals of the second material web by means of a second transverse position detecting device upstream the pressing device in conveying direction of the second material web, and receiving the first transverse position signals of the first material web and the second transverse position signals of the second material web by a signal processing unit, which is in signalling connection with the second unrolling device, and when a transverse deviation between the first material web and the second material web over a setpoint value is established on the basis of the first and second transverse position signals, actuating the second unrolling device in such a way that the second material web in the device for producing a corrugated board web which is laminated on one side is displaced in its transverse direction to reduce the transverse deviation.

The essence of the invention lies in the use of transverse position detecting devices, which are arranged upstream of the fluting device or pressing device and sense the transverse positions of the material webs, for example during production operation of the assembly or when it is started up. The transverse position detecting devices are preferably arranged downstream of the unrolling devices or their respective connecting assembly. The signal processing unit processes the transverse position signals of the transverse position detecting devices that correlate with the transverse positions of the material webs. When a deviation with respect to or over a setpoint value (interval) is established, the signal processing unit initiates a displacement of the second material web in its transverse direction in the device for producing a corrugated board web which is laminated on one side, so that the transverse deviation between the first material web and the second material web is reduced or becomes zero there. The signal processing unit is capable of initiating a displacement of the second material web in the device for producing a corrugated board web which is laminated on one side, if appropriate, from its actual position into its intended position.

The second unrolling device is for example capable of influencing the second material web, such as shifting or deflecting it in its transverse direction, in such a way that it is correspondingly displaced in the device for producing a corrugated board web which is laminated on one side. It is expedient if, for this purpose, a corresponding adjustment of the second material web and/or the at least one second material web roll is performed in the device for producing a corrugated board web which is laminated on one side. Preferably, for this purpose, at least one device of the second unrolling device is correspondingly displaceable. For example, in the case of a transverse displacement of the second material web in the device for producing a corrugated board web which is laminated on one side, a displacement of the same is performed along at least one roller, such as a fluted roller, glue application roller and/or pressing roller, of the device for producing a corrugated board web which is laminated on one side.

The second unrolling device unrolls the second material web in accordance with an intended presetting in such a way that it can be connected in the device for producing a corrugated board web which is laminated on one side for example substantially congruently with the first material web or centrally therewith with respect to its transverse direction. The material webs then have no transverse deviation or a transverse deviation in relation to one another that lies within a setpoint value. Subsequent edge trimming of a corrugated board web which is laminated on both sides can in this way be made minimal or entirely superfluous.

The fluting device favourably comprises a first fluted roller and a second fluted roller arranged adjacent to it, which for leading through and fluting the first material web form a fluting gap. The axes of rotation or longitudinal central axes of the fluted rollers preferably run parallel to one another. The first and/or second fluted roller is preferably heatable.

The glue application device preferably has a glue container and a glue application roller. It is expedient if the glue application roller forms with the first fluted roller a glue gap for leading through and gluing the corrugated web. It is of advantage if the glue application roller applies the glue located in the glue container to tips of the corrugation of the corrugated web. The glue application device follows the fluting device in conveying direction of the corrugated web.

The pressing device is preferably formed as a pressing band device, which favourably has at least two pressing band deflecting rollers and an endless pressing band passed around the pressing band deflecting rollers. The pressing band preferably presses against the second material web, which in turn is pressed against the endless corrugated web provided with glue, lying against the first fluted roller. The pressing device follows the fluting device in conveying direction of the corrugated web.

It is expedient if the first transverse position detecting device operates in a contactless manner. It is preferably capable of detecting the current position or the current path of the first material web in its transverse direction, preferably continuously. The first transverse position detecting device is for example capable of directly detecting a position or a path of at least one outer side or longitudinal border or edge of the first material web. The first transverse position detecting device is for example designed as a light grid, sensor, camera, ultrasonic detecting device or infrared detecting device.

The second transverse position detecting device is favourably formed in the same way as the first transverse position detecting device. It is expedient if the second transverse position detecting device operates in a contactless manner. It is preferably capable of detecting the current position or the current path of the second material web in its transverse direction, preferably continuously. The second transverse position detecting device is for example capable of directly detecting a position or a path of at least one outer side or longitudinal border or edge of the second material web. The second transverse position detecting device is for example designed as a light grid, sensor, camera, ultrasonic detecting device or infrared detecting device.

The transverse position signals are preferably electrical signals.

The signal processing unit is preferably an electrical, preferably electronic, signal processing unit. It is for example designed as an open-loop and/or closed-loop control unit.

The signal connection between the first transverse position detecting device and the signal processing unit is preferably designed as wireless or wire-bound. The signal connection between the second transverse position detecting device and the signal processing unit is favourably designed as wireless or wire-bound. The signal connection between the second unrolling device and the signal processing unit is also preferably designed as wireless or wire-bound.

The assembly is preferably a component part of a corrugator. The corrugated board web which is laminated on one side can preferably be used to produce a corrugated board web which is laminated on both sides.

The assembly, in which the first transverse position detecting device is positioned upstream of the device for producing a corrugated board web which is laminated on one side in conveying direction of the first material web, is extremely functionally reliable.

The assembly, in which the second transverse position detecting device is positioned upstream of the device for producing a corrugated board web which is laminated on one side in conveying direction of the second material web, also provides a particularly functionally reliable assembly.

The assembly, in which the second unrolling device is formed as a splicing device for producing an endless second material web, is extremely cost-effective. The first material web is also favourably endless. It is expedient if the corrugated board web which is laminated on one side is likewise endless.

It is of advantage if the second unrolling device comprises two unrolling devices for unrolling two finite second material webs from two second material web rolls. The second unrolling device favourably has a connecting assembly for connecting the finite second material webs to form an endless second material web. It is of advantage if the connecting assembly comprises a first preparation unit, a second preparation unit, a first connecting unit for connecting a web end of a finite second material web to a web beginning of the other finite second material web and a table device for interacting with the preparation units and the connecting units.

It is expedient if the at least one receiving device, in which the second unrolling device has at least one receiving device for receiving the at least one second material web roll, wherein the at least one receiving device is displaceable, in particular is shiftable and/or is tiltable, with respect to a basic position for displacing the second material web in its transverse direction in dependence on the transverse deviation in the device for producing a corrugated board web which is laminated on one side, comprises at least one receiving part or holding part, such as a rod, mandrel, cone or the like, which preferably at least engages in a central opening of the at least one second material web roll. It is of advantage if the at least one receiving device can be transversely shifted out of its basic position or neutral position and/or is tiltable or can be obliquely adjusted, for example about a vertical pivot axis. In the basic position of the at least one receiving device, the second unrolling device unrolls the second material web normally. A corresponding displacement, such as shifting or tilting, of the at least one deflecting roller out of the basic position with respect to the second material web leads to a changing of the running direction of the second material web in its transverse direction.

The material web storage carriage, in which the second unrolling device has a displaceable material web storage carriage for storing the second material web, wherein the material web storage carriage is at least partially displaceable, in particular is shiftable and/or is tiltable, with respect to a basic position for displacing the second material web in its transverse direction in dependence on the transverse deviation in the device for producing a corrugated board web which is laminated on one side, allows an uninterrupted conveyance of the second material web. For this purpose, it is preferably displaceable along a material web storage carriage track or guide. Furthermore, the material web storage carriage can be at least partially shifted transversely out of its basic position or neutral position and/or is tiltable or can be pivoted or can be obliquely adjusted, for example about a vertical pivot axis. The material web storage carriage preferably has at least one deflecting roller for deflecting the second material web. The at least one deflecting roller is shiftable transversely, in particular out of a basic position or neutral position, and/or is tiltable or can be pivoted or can be obliquely adjusted, for example about a vertical pivot axis. A corresponding displacement, such as shifting or tilting, of the at least one deflecting roller out of the basic position with respect to the second material web leads to a changing of the running direction of the second material web in its transverse direction.

If appropriate, the signal processing unit initiates an adjustment of, such as regulates, the second material web in its second transverse position to the first transverse position of the first material web. The first material web thus favourably forms a master material web, while the second material web preferably forms a slave material web. By analogy, the first unrolling device preferably forms a master unrolling device, while the second unrolling device preferably forms a slave unrolling device. An opposite configuration is alternatively possible.

The fluted roller, in which the signal processing unit is capable of actuating the first unrolling device in such a way that at least one side edge of the first material web is spaced from outer grooves of at least one fluted roller of the fluting device, wherein the outer grooves of the respective fluted roller cut a fluting of this fluted roller, is extremely functionally reliable and also has a particularly long service life. It is expedient if the outer or outer-side grooves are in flow connection with at least one negative pressure source, in order that the first material web is held on the fluted roller and lies well in depressions of its fluting. Outer grooves are preferably spaced from one another along the fluted roller. These outer grooves of the fluted roller preferably run uniformly at a distance from one another. The outer grooves are preferably radially outwardly open. They run at least in certain regions around a longitudinal central axis of the fluted roller and preferably have a uniform width. They preferably cut, for example perpendicularly or obliquely, a fluting of this fluted roller, which preferably alternately has fluting teeth and fluting troughs. The outer grooves are preferably designed as annular grooves. They preferably form suction grooves. It is of advantage if the signal processing unit recognises the path or the position of the outer grooves, in particular their position with reference to a longitudinal extent, of the fluted roller used. For example, for this purpose the signal processing unit falls back on a database or on data, for example external data, concerning the fluted roller. The position of the outer grooves is preferably read out from a fluted roller cartridge carrying the at least one fluted roller. This alignment of the first material web with respect to the fluted roller is performed in particular during the initial operation of the assembly. It is preferably retained during production operation. Preferably, both side edges of the first material web are then spaced from the outer grooves. The arrangement of the side or longitudinal edge(s) of the first material web in relation to the outer grooves of the fluted roller at a distance, in particular laterally or in the longitudinal direction of the fluted roller, leads to a particularly high-quality corrugated board web which is laminated on one side.

The assembly, in which for establishing the transverse deviation, the signal processing unit calculates a difference between a middle of the first material web with respect to its transverse direction and a middle of the second material web with respect to its transverse direction in the device for producing a corrugated board web which is laminated on one side, is particularly functionally reliable. The middle of the first material web, with respect to its transverse direction, preferably lies between mutually opposite longitudinal or side edges of the first material web. The middle of the second material web, with respect to its transverse direction, preferably lies between mutually opposite longitudinal or side edges of the second material web. There is preferably a middle regulation. When a transverse deviation is established, the difference is above a maximum setpoint value.

The assembly, in which the glue application device has at least one glue dam for lateral delimitation of the gluing of the first material web, wherein the signal processing unit is in signalling connection with at least one glue dam displacement drive and, if appropriate, initiates a displacement of the at least one glue dam in dependence on the established transverse position of the first material web and/or the second material web, is particularly user-friendly. A manual adjustment of the at least one glue dam along a glue application roller is not necessary. When a transverse deviation of the first and/or second material web is established, the at least one glue dam is preferably adjusted or re-adjusted in dependence on the transverse deviation.

The expressions "preceding", "following", "upstream", "downstream" or the like that are used here relate in particular to the conveying direction of the respective material web. The transverse direction of the respective material web is in particular oriented perpendicularly to its conveying direction. It preferably extends over a width of the material web and may also be referred to as the width direction of the material web. The transverse direction runs perpendicularly to the mutually opposite longitudinal or side edges of the respective material web.

A preferred embodiment of the invention is described by way of example below with reference to the accompanying drawing.

DESCRIPTION OF THE PREFERRED EMBODIMENT

Figure 1:
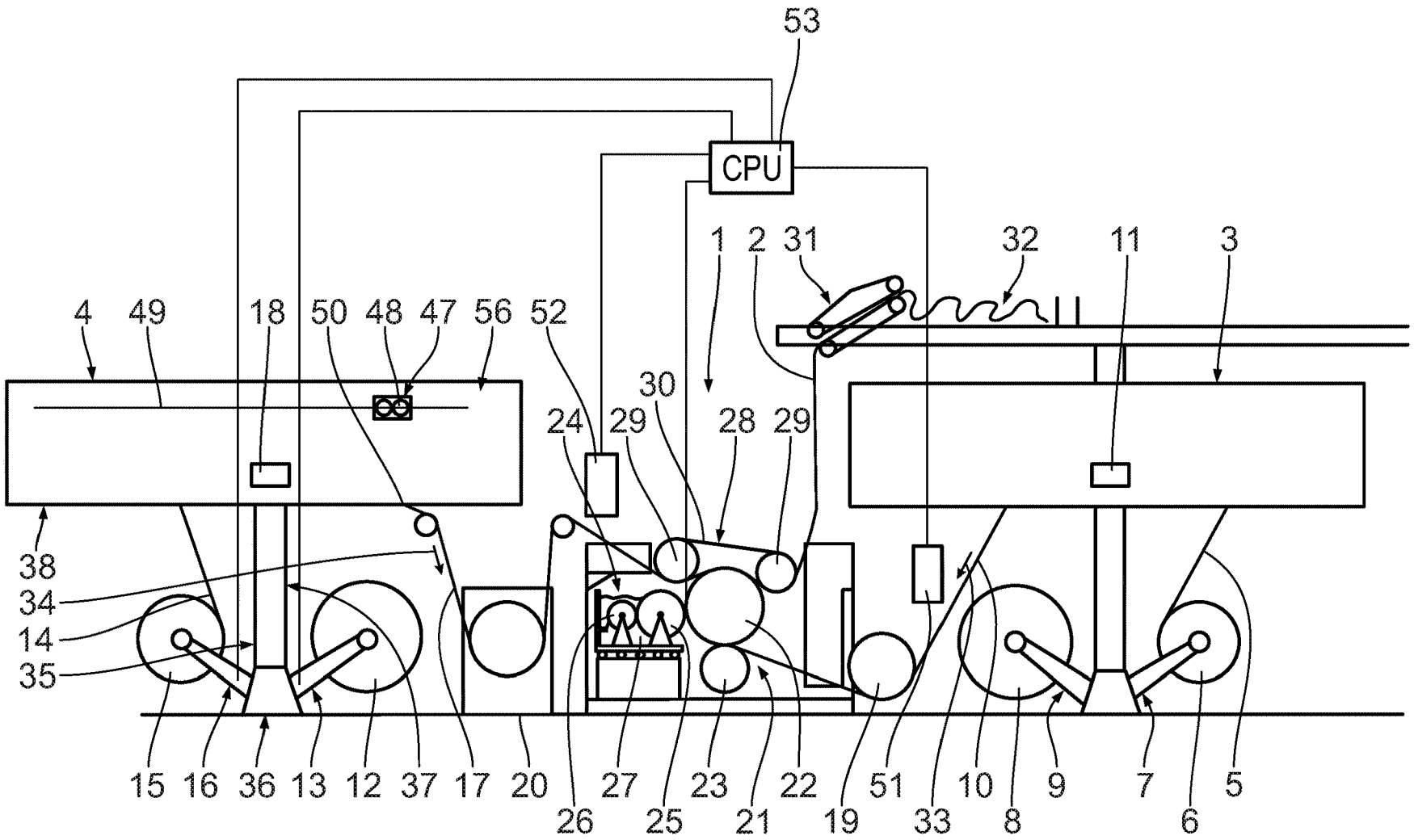
FIG. 1 shows a simplified side view of an assembly according to the invention.

Initially with reference to FIG. 1, a corrugator plant (not shown in its entirety) comprises a device 1 for producing an endless corrugated board web which is laminated on one side and is capable of producing an endless corrugated board web 2 which is laminated on one side.

The device 1 for producing an endless corrugated board web which is laminated on one side is preceded by an inner liner splicing device 3 and an outer liner splicing device 4.

The inner liner splicing device 3 comprises a first unrolling device 7 for unrolling a finite first inner liner 5 from a first inner liner roll 6 and a second unrolling device 9 for unrolling a finite second inner liner from a second inner liner roll 8. To provide an endless inner liner 10, the finite first inner liner 5 and the finite second inner liner are connected to one another by means of a connecting and cutting assembly 11 of the inner liner splicing device 3. The inner liner 5, 10 forms a first material web.

The outer liner splicing device 4 is formed in a way corresponding to the inner liner splicing device 3. It comprises a third unrolling device 13 for unrolling a finite first outer liner from a first outer liner roll 12 and a fourth unrolling device 16 for unrolling a finite second outer liner 14 from a second outer liner roll 15. To provide an endless outer liner 17, the finite first outer liner and the finite second outer liner 14 are connected to one another by means of a connecting and cutting assembly 18 of the outer liner splicing device 4. The outer liner 14, 17 forms a second material web.

The endless inner liner 10 is fed by way of a deflecting roller 19 in a first conveying direction 33 to the device 1 for producing an endless corrugated board web which is laminated on one side, while the endless outer liner 17 is fed by way of a heating device 20 in a second conveying direction 34 to the device 1 for producing an endless corrugated board web which is laminated on one side.

The device 1 for producing an endless corrugated board web which is laminated on one side comprises a fluting device 21, with a first fluted roller 22 and a second fluted roller 23, for producing an endless corrugated web, having a corrugation, from the endless inner liner 10. The fluted rollers 22, 23 are spaced from one another. They form a fluting gap for leading through and fluting the endless inner liner 10. The fluted rollers 22, 23 are mounted in a rotatable or rotatably driveable manner. The axes of rotation of the fluted rollers 22, 23 run parallel to one another.

For connecting the endless outer liner 17 to the endless corrugated inner liner or corrugated web 10 to form the endless corrugated board web 2 which is laminated on one side, the device 1 for producing an endless corrugated board web which is laminated on one side has a glue application device 24, which favourably comprises a glue application roller 25, a glue metering roller 26 and a glue container 27. For leading through and gluing the endless corrugated web 10, the glue application roller 25 forms a gluing gap with the first fluted roller 22. The glue that is in the glue container is applied by way of the glue application roller 25 to tips of the corrugation of the endless corrugated web 10. The glue metering roller 26 lies against the glue application roller 25 and serves for forming a uniform layer of glue on the glue application roller 25.

The smooth endless outer liner 17 is subsequently joined together with the endless corrugated web 10, provided with glue from the glue container 27, in the device 1 for producing an endless corrugated board web which is laminated on one side. For pressing the endless outer liner 17 against the endless corrugated web 10, provided with glue, which in turn lies in certain regions against the first fluted roller 22, the device 1 for producing an endless corrugated board web which is laminated on one side has a pressing band device 28. The pressing band device 28 is arranged above the first fluted roller 22. It has at least two pressing-band deflecting rollers 29, spaced from one another, and an endless pressing band 30, which is led around the pressing-band deflecting rollers 29. The first fluted roller 22 reaches into a space between the pressing-band deflecting rollers 29 in certain regions from below, whereby the pressing band 30 is deflected by the first fluted roller 22. The pressing band 30 presses against the endless outer liner 17, which in turn is pressed against the endless corrugated web 10, provided with glue, lying against the first fluted roller 22.

For intermediately storing and buffering the endless corrugated board web 2 which is laminated on one side, it is fed by way of a vertical transporting device 31 to a storage device 32 of the corrugator, where the latter forms loops.

The corrugator plant also comprises a laminating web splicing device (not represented), which is designed in a way corresponding to the inner liner splicing device 3 or outer liner splicing device 4. The laminating web splicing device is capable of producing an endless laminating web.

Downstream of the storage device 32 and the laminating web splicing device, the corrugator plant has a preheating device (not represented) with two preheating rollers arranged one above the other. The endless corrugated board web 2 which is laminated on one side and the endless laminating web are fed to the preheating device and circumferentially wrap around the respective preheating roller in certain regions.

Downstream of the preheating device, the corrugator plant has a glue unit (not represented) with a gluing roller, which is partially immersed in a glue bath. Lying against the gluing roller is a glue metering roller, in order to form a uniform layer of glue on the gluing roller. The endless corrugated board web 2 which is laminated on one side is in contact by its corrugated web 10 with the gluing roller, so that the corrugation of this corrugated web 10 is provided with glue from the glue bath.

Downstream of the glue unit, the corrugator plant has a heating pressure-exerting device (not represented), which comprises a horizontally running heating table. Arranged adjacent to the heating table is an endless pressure-exerting belt, which is led around guiding rollers. Formed between the pressure-exerting belt and the heating table is a pressure-exerting gap, through which the endless corrugated board web 2 which is laminated on one side and the endless laminating web are led to form an endless, three-ply corrugated board web. The endless corrugated web or inner liner 10 is located between the endless outer liner 17 and the endless laminating web.

Downstream of the heating pressure-exerting device, the corrugator plant has a longitudinal cutting/grooving device (not represented) for longitudinally cutting and grooving the endless, three-ply corrugated board web. In the longitudinal cutting/grooving device, endless partial webs, which initially still run next to one another, can be produced from the endless, three-ply corrugated board web.

Downstream of the longitudinal cutting/grooving device, the corrugator plant has a turnout (not represented), in order to convey the partial webs into different planes.

Downstream of the turnout, the corrugator plant has a transverse cutting device (not represented) with transverse cutting devices arranged one above the other. The transverse cutting devices produce corrugated board sheets from the partial webs.

Downstream of the transverse cutting devices, the corrugator plant has a stacking device (not represented), which stacks the corrugated board sheets.

Figure 2:
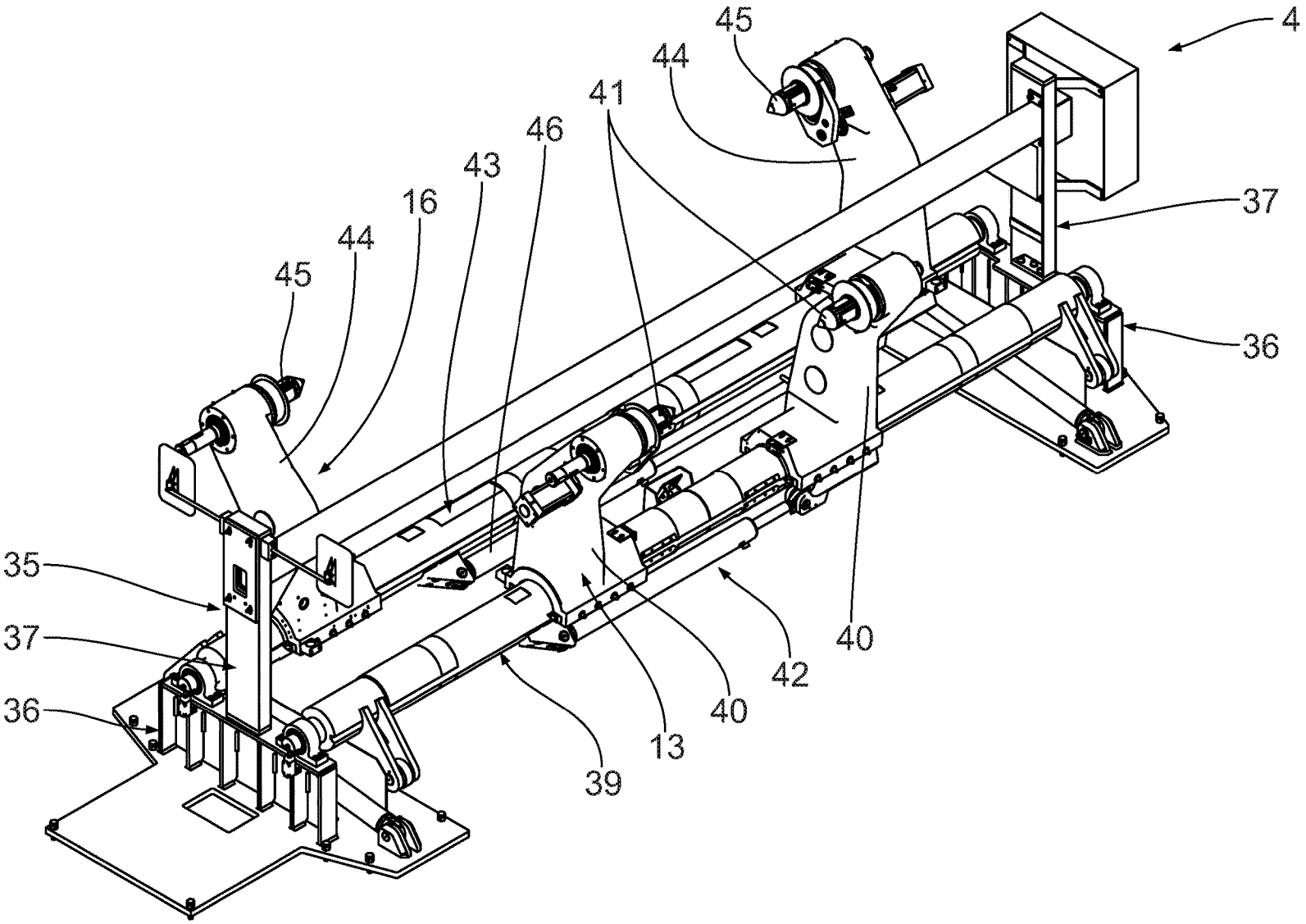
FIG. 2 shows a perspective detailed view of a lower part of a splicing device illustrated in its entirety in FIG. 1.

The outer liner splicing device 4 is described in more detail below, also with reference to FIG. 2. The inner liner splicing device 3 is for example identically designed.

The outer liner splicing device 4 has a base frame 35 with two base frame pedestals 36, two base frame stands 37 and two base frame carriers 38. The base frame pedestals 36 are fastened to a floor or underlying surface. Arranged on each base frame pedestal 36 is a base frame stand 37. Each base frame stand 37 extends vertically or perpendicularly to the floor. Each base frame carrier 38 is arranged at an end of the base frame stand 37 opposite from the associated base frame pedestal 36 and runs parallel to the floor. The base frame carriers 38 carry a splicing device of the outer liner splicing device 4.

Mounted on the base frame pedestals 36 is an elongated first carrying assembly 39. The first carrying assembly 39 extends between the base frame pedestals 36 and perpendicularly to a longitudinal extent of the corrugator. It carries the third unrolling device 13 and runs horizontally. The first carrying assembly 39 is substantially cylindrical.

The third unrolling device 13 has two first carrying arms 40, which are arranged along the first carrying assembly 39 and carry in each case a first receiving part 41. According to FIG. 1, the first receiving parts 41 are led into a central opening of the first outer liner roll 12 and rotatably mounted. They engage in the first outer liner roll 12 from both end faces and form a first receiving device. A longitudinal central axis of the first outer liner roll 12 runs parallel to the first carrying assembly 39.

The first carrying arms 40 is shiftable in relation to one another along the first carrying assembly 39, in order that first outer liner rolls 12 of different widths can be received. For this purpose, the outer liner splicing device 4 has a first piston-cylinder unit 42, which is variable in its length and is connected to the first carrying arms 40. The first piston-cylinder unit 42 preferably operates hydraulically. The first carrying arms 40 can also be shifted jointly as one along the first carrying assembly 39, which leads to a shifting of the first outer liner roll 12 along its longitudinal central axis or of the finite first outer liner unrolled from it in its transverse direction. The first carrying arms 40 can be pivoted jointly about the first carrying assembly 39, which provides a horizontally running pivot axis. Such pivoting is performed for example when receiving or delivering the first outer liner roll 12. The first carrying arms 40 can also be pivoted in relation to one another about the first carrying assembly 39, which allows a tilting of the first outer liner roll 12, and consequently a deflection of the finite first outer liner or endless outer liner 17 in its transverse direction.

Also mounted on the base frame pedestals 36 is an elongated second carrying assembly 43. The second carrying assembly 43 extends between the base frame pedestals 36 and perpendicularly to a longitudinal extent of the corrugator. It runs parallel to the first carrying assembly 39. It carries the fourth unrolling device 16 and runs horizontally. The third unrolling device 13 and fourth unrolling device 16 are arranged opposite one another in relation to the base frame carrier 38. The second carrying assembly 43 is substantially cylindrical.

The fourth unrolling device 16 has two second carrying arms 44, which are arranged along the second carrying assembly 43 and carry in each case a second receiving part 45. According to FIG. 1, the second receiving parts 45 are led into a central opening of the second outer liner roll 15 and rotatably mounted. They engage in the second outer liner roll 15 from both end faces and form a second receiving device. A longitudinal central axis of the second outer liner roll 15 runs parallel to the second carrying assembly 43.

The second carrying arms 44 are shiftable in relation to one another along the second carrying assembly 43, in order that second outer liner rolls 15 of different widths can be received. For this purpose, the outer liner splicing device 4 has a second piston-cylinder unit 46, which is variable in its length and is connected to the second carrying arms 44. The second piston-cylinder unit 46 preferably operates hydraulically. The second carrying arms 44 can also be shifted jointly as one along the second carrying assembly 43, which leads to a shifting of the second outer liner roll 15 along its longitudinal central axis or of the finite second outer liner unrolled from it in its transverse direction. The second carrying arms 44 can be pivoted jointly about the second carrying assembly 43, which provides a horizontally running pivot axis. Such pivoting is performed for example when receiving or delivering the second outer liner roll 15. The second carrying arms 44 can also be pivoted in relation to one another about the second carrying assembly 43, which allows a tilting of the second outer liner roll 15, and consequently a deflection of the finite second outer liner 14 or endless outer liner 17 in its transverse direction.

The finite first outer liner and the finite second outer liner 14 are led from the respective outer liner roll 12 or 15 into the splicing device of the outer liner splicing device 4.

According to FIG. 1, the finite second outer liner 14, which is just forming the endless outer liner 17, is led through the cutting and connecting assembly 18 and led to a following outer liner storage carriage 47, which comprises at least one deflecting roller 48 for deflecting the endless outer liner 17 and is displaceable along a guide 49 for producing or eliminating loops of the endless outer liner 17. The guide 49 extends parallel to the floor, and consequently horizontally. The at least one deflecting roller 48 is tiltable along the guide 49 or in its plane. In its basic position, the at least one deflecting roller 48 runs perpendicularly to the conveying direction 34 of the endless outer liner 17. With respect to a possible adjustment of the at least one deflecting roller 48 and an advantageous exact construction of the outer liner splicing device 4 and its preferred function, reference is made for example to US 2015/0291380 A1.

The finite first outer liner is preferably kept in the cutting and connecting arrangement 18 for later use.

The outer liner storage carriage 47 is followed by an outer liner exit 50 of the outer liner splicing device 4.

Figure 3:
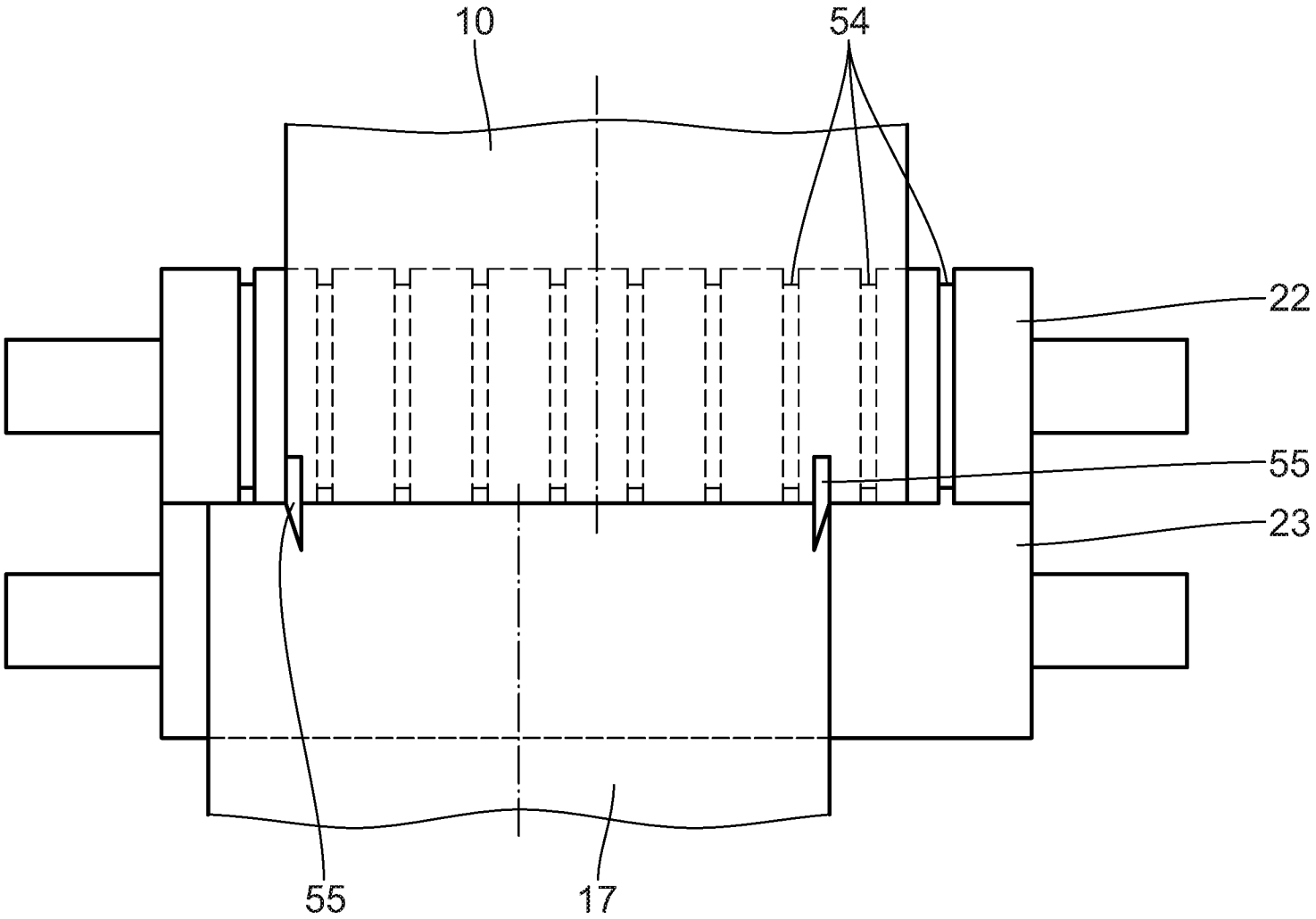
FIG. 3 shows a simplified partial view of the device shown in FIG. 1 for producing a corrugated board web which is laminated on one side, which illustrates the arrangement of the material webs in the device for producing a corrugated board web which is laminated on one side and the glue dams.

As FIG. 3 shows, the first fluted roller 22 has a multiplicity of annular grooves 54, which are spaced from one another along the first fluted roller 22 and extend around the longitudinal central axis of the first fluted roller 22. They are outwardly open and endless. The annular grooves 54 run in planes that run perpendicularly to the longitudinal central axis of the first fluted roller 22. The second fluted roller 23 preferably has no annular grooves.

The glue application device 24 has two glue dams 55, which lie closely against the first fluted roller 22 and run perpendicularly to it. They are shiftable along the first fluted roller 22. The glue dams 55 can in this case be shifted in relation to one another or else jointly as one.

The endless inner liner 10 is assigned a first transverse position detecting device 51, which is arranged between the inner liner splicing device 3 and the device 1 for producing an endless corrugated board web which is laminated on one side, to be more precise between the inner liner splicing device 3 and the deflecting roller 19. The first transverse position detecting device 51 consequently follows an inner liner exit of the inner liner splicing device 3 in conveying direction 33 of the endless inner liner 10. It is positioned upstream of the fluting device 23 in conveying direction 33 of the endless inner liner 10.

The endless outer liner 17 is assigned a second transverse position detecting device 52, which is arranged between the heating device 20 and the pressing band device 28 of the device 1 for producing an endless corrugated board web which is laminated on one side. The second transverse position detecting device 52 consequently follows the outer liner splicing device 4 or its outer liner exit 50 in conveying direction 34 of the endless outer liner 34. It is positioned upstream of the pressing band device 28 in conveying direction 34 of the endless outer liner 34.

The first transverse position detecting device 51 and the second transverse position detecting device 52 are in signalling connection with a signal processing unit 53. The signal processing unit 53 receives from the transverse position detecting devices 51, 52 signals that concern the respective current transverse position of the endless inner liner 10 and outer liner 17. It knows the position of the annular grooves 54 of the first fluted roller 22. The signal processing unit 53 preferably also knows the length of the endless inner liner 10 between the inner liner splicing device 3 and the first transverse position detecting device 51. It preferably also knows the length of the endless inner liner 10 between the first transverse position detecting device 51 and the device 1 for producing an endless corrugated board web which is laminated on one side. The signal processing unit 53 preferably also knows the length of the endless outer web 17 between the outer web splicing device 4 and the second transverse position detecting device 52. It preferably also knows the length of the endless outer liner 17 between the second transverse position detecting device 52 and the device 1 for producing an endless corrugated board web which is laminated on one side.

The signal processing unit 53 evaluates the transverse positions of the endless inner liner 10 and outer liner 17 in relation to one another that are sensed by the first transverse position detecting device 51 and second transverse position detecting device 52. For determining a transverse deviation or a lateral offset of the endless inner liner 10 and the endless outer liner 17 in relation to one another, it calculates a difference between a middle of the endless inner liner 10 and the endless outer liner 17 present with respect to the transverse direction.

The signal processing unit 53 is capable of detecting a lateral offset of the material webs or of the endless inner liner and outer liner 10, 17 in relation to one another. If the signal processing unit 53 in this case establishes a deviation between an actual value and a setpoint value, a corresponding transverse displacement of the second material web or endless outer liner 17 is performed in the device 1 for producing an endless corrugated board web which is laminated on one side, for example along the first fluted roller 22 and the pressing-band deflecting rollers 29. For this, the corresponding actuation of the outer liner splicing device 4 is performed in dependence on the transverse deviation sensed.

For this purpose, the signal processing unit 53 is in signalling connection with the outer liner storage carriage 47 and the unrolling devices 13, 16 or with corresponding displacement drives for the corresponding displacement or adjustment of the same. The signalling connection may be designed as wireless or wire-bound. Alternatively, for this purpose the signal processing unit 53 is in signalling connection with the outer liner storage carriage 47 or the unrolling devices 13, 16 or with at least one corresponding displacement drive for the corresponding displacement or adjustment of the outer liner storage carriage 47 or the unrolling devices 13, 16. Alternatively or in addition, for this purpose the signal processing unit 53 is in signalling connection with the inner liner splicing device 3, in particular its inner liner storage carriage and/or unrolling devices 7, 9 or with corresponding displacement drives for the corresponding displacement or adjustment of the same.

The signal processing unit 53 is in signalling connection, which is designed as wireless or wire-bound, with the glue dams 55 or corresponding displacement drives for the displacement of the same. In the case of a transverse displacement of the endless inner liner 10 in the device 1 for producing a corrugated board web which is laminated on one side, a displacement of the glue dams 55 is correspondingly performed.

At the beginning or for the initial operation of the assembly, the signal processing unit 53 actuates the first unrolling device 3 in such a way that the two side edges of the endless inner liner 10 are arranged offset laterally in relation to the annular grooves 54 of the first fluted roller 22 or offset along the first fluted roller 22 in relation to the annular grooves 54.

According to an alternative embodiment, the corrugator plant is capable of producing a five-ply corrugated board web. There are then favourably two of the assemblies.

What is claimed is:

1. An assembly, comprising:

a first unrolling device for unrolling a first material web from at least one first material web roll;

a second unrolling device for unrolling a second material web from at least one second material web roll;

a device for producing a corrugated board web which is laminated on one side from the first material web and the second material web, wherein the device for producing a corrugated board web which is laminated on one side has a fluting device for fluting the first material web to form a corrugated web, a glue application device for gluing the corrugated web, a pressing device for pressing the glued corrugated web and the second material web against one another to form a corrugated board web which is laminated on one side, and an exit for the corrugated board web which is laminated on one side;

a first transverse position detecting device, upstream of the fluting device in a conveying direction of the first material web, for detecting a respective first transverse position of the first material web to produce first transverse position signals of the first material web;

a second transverse position detecting device, upstream of the pressing device in a conveying direction of the second material web, for detecting a respective second transverse position of the second material web to produce second transverse position signals of the second material web; and a signal processing unit in signaling connection with the first transverse position detecting device for receiving the first transverse position signals of the first material web, the signal processing unit being in signaling connection with the second transverse position detecting device for receiving the second transverse position signals of the second material web, the signal processing unit being in signaling connection with the second unrolling device, wherein when a transverse deviation between the first material web and the second material web is established on basis of the first and second transverse position signals over a setpoint value, the signal processing unit is configured to actuate the second unrolling device in such a way that the second material web in the device for producing a corrugated board web which is laminated on one side is displaced in its transverse direction to reduce the transverse deviation, wherein the signal processing unit is configured to actuate the first unrolling device in such a way that at least one side edge of the first material web is spaced from outer grooves of at least one fluted roller of the fluting device, wherein the outer grooves of the respective fluted roller cut a fluting of this fluted roller.

2. The assembly according to claim 1, wherein the first transverse position detecting device is positioned upstream of the device for producing a corrugated board web which is laminated on one side in the conveying direction of the first material web.

3. The assembly according to claim 1, wherein the second transverse position detecting device is positioned upstream of the device for producing a corrugated board web which is laminated on one side in the conveying direction of the second material web.

4. The assembly according to claim 1, wherein the second unrolling device is formed as a splicing device for producing an endless second material web.

5. The assembly according to claim 1, wherein the second unrolling device has at least one receiving device for receiving the at least one second material web roll, wherein the at least one receiving device is displaceable with respect to a basic position for displacing the second material in its transverse direction in dependence on the transverse deviation in the device for producing a corrugated board web which is laminated on one side.

6. The assembly according to claim 5, wherein the at least one receiving device is at least one of shiftable and tiltable with respect to a basic position for displacing the second material web in its transverse direction in dependence on the transverse deviation in the device for producing a corrugated board web which is laminated on one side.

7. The assembly according to claim 1, wherein the second unrolling device has a displaceable material web storage carriage for storing the second material web, wherein the material web storage carriage is at least partially displaceable with respect to a basic position for displacing the second material web in its transverse direction in dependence on the transverse deviation in the device for producing a corrugated board web which is laminated on one side.

8. The assembly according to claim 7, wherein the material web storage carriage is at least one of shiftable and tiltable with respect to a basic position for displacing the second material web in its transverse direction in dependence on the transverse deviation in the device for producing a corrugated board web which is laminated on one side.

9. The assembly according to claim 1, wherein the signal processing unit is configured to initiate an adjustment of the second material web in its second transverse position to the first transverse position of the first material web.

10. The assembly according to claim 1, wherein, for establishing the transverse deviation, the signal processing unit calculates a difference between a middle of the first material web with respect to its transverse direction and a middle of the second material web with respect to its transverse direction in the device for producing a corrugated board web which is laminated on one side.

11. The assembly according to claim 1, wherein the glue application device has at least one glue dam for lateral delimitation of the gluing of the first material web, wherein the signal processing unit is in signaling connection with at least one glue dam displacement drive and the signal processing unit is configured to initiate a displacement of the at least one glue dam in dependence on the established transverse position of at least one of the first material web and the second material web.

12. The assembly according to claim 1, wherein the signal processing unit is configured to recognize a path of the outer grooves.

13. The assembly according to claim 1, wherein the outer grooves form suction grooves.

14. The assembly according to claim 1, wherein the outer grooves are configured as annular grooves.

15. The assembly according to claim 14, wherein the annular grooves extend in planes perpendicular to a longitudinal axis of the at least one fluted roller.

16. A corrugator plant with at least one assembly, comprising:

a first unrolling device for unrolling a first material from at least one first material web roll;

a second unrolling device for unrolling a second material web from at least one second material web roll;

a device for producing a corrugated board web which is laminated on one side from the first material web and the second material web, wherein the device for producing a corrugated board web which is laminated on one side has a fluting device for fluting the first material web to form a corrugated web, a glue application device for gluing the corrugated web, a pressing device for pressing the glued corrugated web and the second material web against one another to form a corrugated board web which is laminated on one side, and an exit for the corrugated board which is laminated on one side;

a first transverse position detecting device, upstream of the fluting device in a conveying direction of the first material web, for detecting a respective first transverse position of the first material web to produce first transverse position signals of the first material web;

a second transverse position detecting device, upstream of the pressing device in a conveying direction of the second material web, for detecting a respective second transverse position of the second material web to produce second transverse position signals of the second material webs; and a signal processing unit in signaling connection with the first transverse position detecting device for receiving the first transverse position signals of the first material web, the signal processing unit being in signaling connection with the second transverse position detecting device for receiving the second transverse position signals of the second material web, the signal processing unit being in signaling connection with the second unrolling device, wherein when a transverse deviation between the first material and the second material web is established based on the first and second transverse position signals over a setpoint value, the signaling processing unit is configured to actuate the second unrolling device in such a way that the second material web in the device for producing a corrugated board web which is laminated on one side is displaced in its transverse direction to reduce the transverse deviation, wherein the signal processing unit is configured to actuate the first unrolling device in such a way that at least one side edge of the first material web is spaced from outer grooves of at least one fluted roller of the fluting device, wherein the outer grooves of the respective fluted roller cut a fluting of this fluted roller.

17. The corrugator plant according to claim 16, wherein the signal processing unit is configured to recognize a path of the outer grooves.

18. The corrugator plant according to claim 16, wherein the outer grooves form suction grooves.

19. A method, comprising the steps of;

unrolling a first material web from at least one first material web roll by means of a first unrolling device;

unrolling a second material web from at least one second material web roll by means of a second unrolling device;

producing a corrugated board web which is laminated on one side from the first material web and the second material web by means of a device for producing a corrugated board web which is laminated on one side, wherein the device for producing a corrugated board web which is laminated on one side has a fluting device for fluting the first material web to form a corrugated web, a glue application device for gluing the corrugated web, a pressing device for pressing the glued corrugated web and the second material web to form the corrugated board web which is laminated on one side, and an exit for the corrugated board web which is laminated on one side;

detecting a respective first transverse position of the first material web to produce first transverse position signals of the first material web by means of a first transverse position detecting device preceding the fluting device in a conveying direction of the first material web;

detecting a respective second transverse position of the second material web to produce second transverse position signals of the second material web by means of a second transverse position detecting device upstream of the pressing device in a conveying direction of the second material web; and receiving the first transverse position signals of the first material web and the second transverse position signals of the second material web by a signal processing unit, which is in signaling connection with the second unrolling device; and when a transverse deviation between the first material and the second material web over a setpoint value is established on the basis of the first and second transverse position signals, actuating the second unrolling in such a way that the second material web in the device for producing a corrugated board web which is laminated on one side is displaced in its transverse direction to reduce the transverse deviation, wherein the signal processing unit is configured to actuate the first unrolling device in such a way that at least one side edge of the first material web is spaced from outer grooves of at least one fluted roller of the fluting device, wherein the outer grooves of the respective fluted roller cut a fluting of this fluted roller.

20. The method according to claim 19, wherein the signal processing unit is configured to recognize a path of the outer grooves.

* * * * *